United States Patent [19]

Fleissner

[11] Patent Number: 4,589,173

[45] Date of Patent: May 20, 1986

[54] APPARATUS FOR CRIMPING SYNTHETIC FILAMENT GROUPS

[75] Inventor: Gerold Fleissner, Chur, Fed. Rep. of Germany

[73] Assignee: Vepa Aktiengesellschaft, Switzerland

[21] Appl. No.: 633,253

[22] Filed: Jul. 23, 1984

[30] Foreign Application Priority Data

Jul. 23, 1983 [DE] Fed. Rep. of Germany ..... 3326589

[51] Int. Cl.[4] ..... D02G 1/12

[52] U.S. Cl. ..... 28/269

[58] Field of Search ..... 28/263, 264, 269

[56] References Cited

U.S. PATENT DOCUMENTS

| | | | |
|---|---|---|---|
| 2,747,233 | 5/1956 | Hitt | 28/269 |
| 3,249,979 | 5/1966 | Stephens et al. | 28/269 |
| 3,373,469 | 3/1968 | Boggs | 28/269 |
| 3,618,183 | 11/1971 | Funk et al. | 28/269 |
| 3,633,255 | 1/1972 | Price | 28/269 |

FOREIGN PATENT DOCUMENTS

| | | | |
|---|---|---|---|
| 1057417 | 2/1967 | United Kingdom | 28/263 |
| 1571521 | 7/1980 | United Kingdom | 28/269 |

*Primary Examiner*—Robert R. Mackey

*Attorney, Agent, or Firm*—Antonelli, Terry & Wands

[57] ABSTRACT

A stuffer box crimping device has a pair of feed pressure rolls and a stuffer box arranged downstream thereof. The stuffer box is laterally delimited by side panels extending up to a nip of the pressure rolls. Pressure plates are supported in the side panels at the level of the pressure roll nip, the pressure plates being in contact with end faces of the rolls with an adjustable pressure. In order to prevent the heating up of the pressure plates during rotation of the pressure rolls, the pressure plates are designed to be cooled during operation. For this purpose, a unit is provided for supplying a cooling liquid against the pressure plate; the liquid being continuously discharged again from the unit after contacting the pressure plate.

7 Claims, 3 Drawing Figures

APPARATUS FOR CRIMPING SYNTHETIC FILAMENT GROUPS

This invention relates to an apparatus for crimping synthetic filament yarns, bundles, or strands with a pair of pressure rolls and a stuffer box arranged downstream thereof, the stuffer box consisting of two panels that are aligned with respect to the rolls and that define a crimping chamber therebetween, one of these panels being made to be pivotable at least in part against; i.e., toward, the other panel in order to reduce the chamber volume, and two lateral plates delimiting the chamber on the sides up to the nip of the pressure rolls. The lateral plates are optionally fixedly held by the non-pivotable panel, these lateral plates each having embedded therein, at the level of the pressure roll nip, a pressure plate in frictional engagement under pressure with the marginal zones of the roll end faces.

A similar apparatus has been known, for example, from DOS No. 2,117,393. The marginal zone between the pressure roll nip of the feed roll pair and the pressure plates is one of the most difficult to control locations of the entire arrangement. Care must be taken, by proper construction, that the fibers, conveyed under high pressure into the stuffer box by the pair of feed rolls, cannot be squeezed out laterally from the apparatus. At the same time, the wear which necessarily must occur between the rotating roll end faces and the fixed pressure plate is to be reduced to a minimum; especially, however, such wear must be uniform on the surface of the pressure plate. In order to achieve this objective, it is known to mount the pressure plate to be rotatable and to drive same stepwise or continuously. In this way, abrasion of the pressure plate intended for wearing takes place uniformly over its contact surface.

Even though the outer surfaces of the feed rolls are usually cooled, a high temperature still arises at the pressure plate, solely due to the friction between the small pressure plates and the end faces of the feed rolls which are of a large circumference in relation thereto. However, the higher the temperature at the pressure plates, the greater the wear. There is even the danger that the pressure plates seize and then rotation to obtain uniform abrasion at the pressure plates is no longer possible. Since each pressure plate is driven only very slowly, it is frequently impossible to immediately notice the seizing of the pressure plate, so that rapidly wear grooves arise on the pressure plate which then make it necessary to replace the pressure plate.

The invention is based on the object of taking measures for overcoming this problem.

Starting with the apparatus of the above-described type, the solution according to this invention resides in that the pressure plates are designed to be coolable during operation. This can be done, for example, by having the respective pressure plate traversed by a cooling liquid, the cooling liquid having a cooling effect on the cooling end face in opposition to the wear face of the pressure plate. The measure of this invention not only prevents disadvantageous heating up of the pressure plate during operation, but also precludes increased wear due to this temperature, whereby the service life of the pressure plate is advantageously increased.

The drawing illustrates an embodiment of the apparatus according to this invention. Additional details of the invention, which are also of importance in combination, will be explained in connection with this embodiment. In the drawing.

Figure 1:
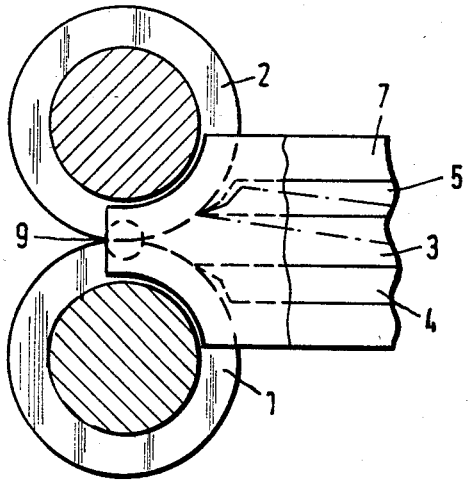
FIG. 1 is a lateral view of a stuffer box crimping device in the zone of the pair of pressure rolls.
Figure 2:
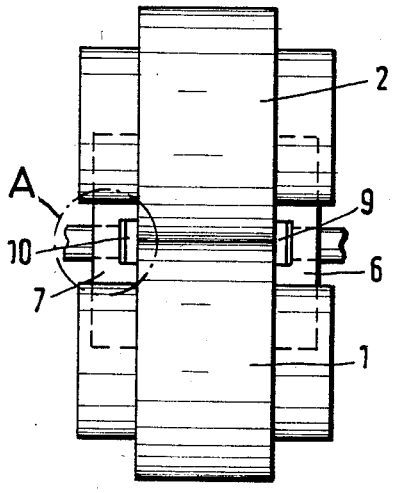
FIG. 2 shows the stuffer box crimping device in a frontal view in the direction of the entering material.

The apparatus for crimping synthetic filament groups comprises rolls 1 and 2 serving as the feed and pressure roll pair, and the stuffer box 3 arranged thereafter, which stuffer box is defined by the two panels 4, 5 aligned axially with respect to the rolls 1, 2—the panel 5 being mounted to be pivotable with respect to the panel 4 for reducing the chamber volume of the stuffer box 3—and by the two lateral plates 6, 7 extending up to the pressure roll nip 8. The lateral plates 6, 7 are rigidly mounted to the lower panel 4.

At the level of the pressure roll nip 8, pressure plates 9, 10 are freely rotatably supported in the lateral plates 6, 7. For the sake of simplicity, the drive mechanism for rotating the pressure plate about its horizontal axis has been omitted since it is of no significance for explaining the present invention.

Figure 3:
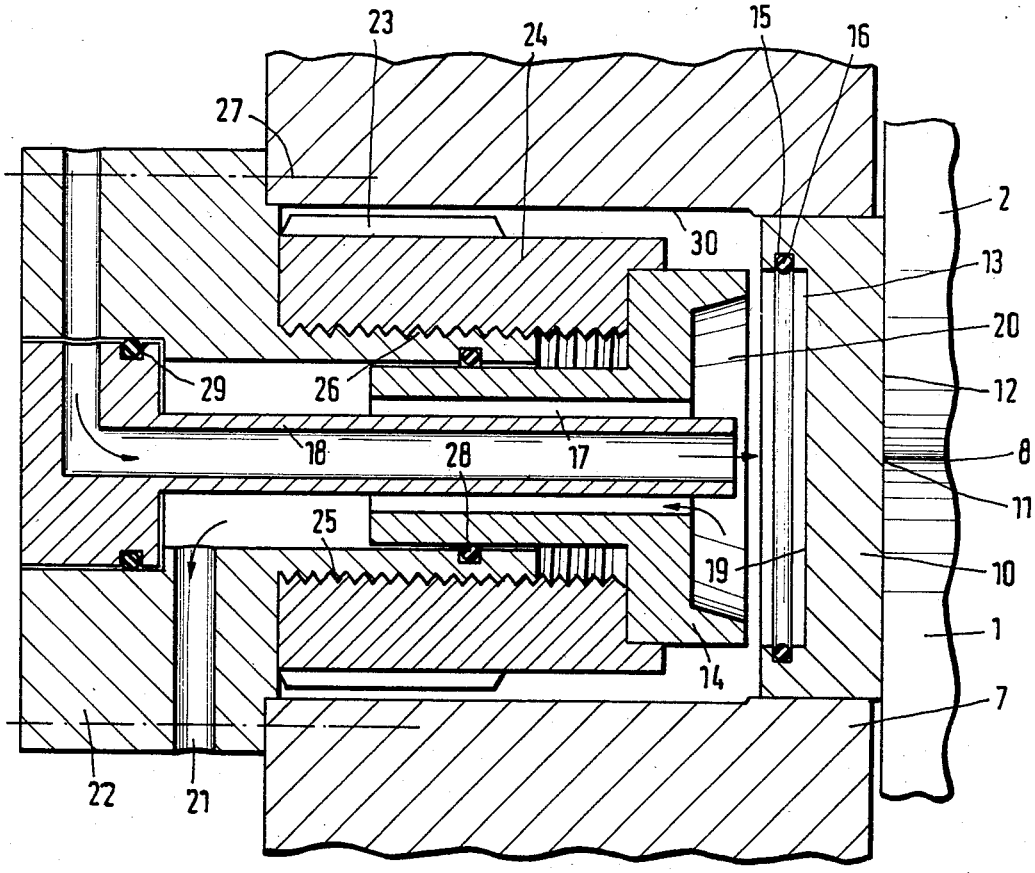
FIG. 3 shows a section through the pair of pressure rolls in the zone of the lateral plate according to the cooling unit A as shown in FIG. 2.

According to FIG. 3, the pressure plate 10 is in contact, with its wearing face 12, with the revolving end faces of rolls 1, 2. On account of the exactly worked surfaces, no filament can laterally slip out of the pressure roll nip 8 at location 11. The pressure plate 10 is arranged, according to FIG. 3, centrally with respect to the pressure roll nip 8. It is advantageous to make this mounting eccentrically to also prevent the penetration of a spike, constantly created by the abrasion and not having been worn down, into the opening of the pressure roll nip 8. On the end face of the pressure plate 10 in opposition to this wearing surface 12, a circular groove 13 has been recessed; this groove should have a maximally large diameter. A cylindrical unit 14, here illustrated with a spacing from the pressure plate, can be inserted in the opening of this groove 13 and can enter the groove 13 up to a stop so that it is flush with its outer surface. For sealing purposes, an annular groove 15 is furthermore worked into the groove 13 of the pressure plate 10, a circular rubber gasket 16 being housed in this annular groove. The unit 14 has a central bore 17 wherein, spaced therefrom, a liquid feed pipe 18 is centrally arranged. The cooling liquid flows through this pipe 18 toward the groove surface 19 on the end face into the groove 13, cools this surface 19 and, thus, the pressure plate 10 as a whole, and then flows back via a collecting groove 20 at the end face of unit 14 through the free annular space in the bore 17 of unit 14, whereupon it is discharged through a bore 21 in a mounting flange 22 of cooling unit A outside of the lateral plate 7.

The pressure plate 10, on the one hand, must be held under a pressure from the outside against the roll end faces; on the other hand, it must be exchangeable. For this reason, the cylindrical unit 14 is fashioned to be reciprocatable in a bore 30 in the lateral plate 7. Thus, a thrust ring 24 provided with an external serration 23 engages, with a frictional connection, the unit 14. The thrust ring has an internal thread along the inner bore. This thread engages into a tubular flange 25 of the mounting flange 22 which latter has, in this zone, an outer thread 26 fitting into the inner thread of the thrust ring 24. Since the mounting flange 22 is fixedly mounted by way of screws 27, for example, to the lateral plate 7, the thrust ring 24, on account of this thread 26, will then move, when rotated with the aid of the external serration 23, depending on the direction of rotation, in the direction of the pressure plate 10 or in the opposite direction. The gear wheel necessary for driving the thrust ring 24 and engaging into the outer serration 23 is arranged, offset by 90°, in front of or behind the cooling unit A shown in FIG. 3, and, therefore, cannot be seen in the drawing. With the aid of this construction, it is possible to produce the pressure required to generate the necessary seal and also to provide the freedom for dismounting and installing the pressure plate 10.

Since the cylindrical unit 14 must be held in the mounting flange 22 to be movable forwards and backwards, this unit is sealed off with respect to the returning liquid by means of a ring gasket 28 in the tubular flange 25. The entering liquid, according to this embodiment, flows from a radial direction in the mounting flange 22, for which purpose a ring gasket 29 is likewise provided between this mounting flange and the liquid feed pipe 18. A different construction is also possible for the arrangement of the unit 14.

I claim:

1. An apparatus for crimping synthetic filament yarns, groups, bundles, or strands comprising a pair of pressure rolls with a nip formed therebetween and a stuffer box arranged downstream thereof, said stuffer box comprising two panels aligned with respect to the rolls, a crimping chamber defined in part by said panels, one of said panels being pivotable at one end to move toward the other stationary panel in order to reduce the chamber volume, and two lateral plates delimiting the chamber on each side up to the pressure roll nip; the lateral plates being fixedly secured to the non-pivotable stationary panel, and the lateral plates each having embedded therein, at the level of nip between the pair of pressure rolls, a pressure plate in frictional engagement under pressure with the marginal zones of the roll end faces, said pressure plates being operatively associated with means for transmitting axial pressure thereto and with means for cooling the plates during operation of the stuffer box; each pressure plate being provided on a cooling end face with a central, circular groove in which can be inserted in the axial direction a cooling liquid supply and discharge unit of said cooling means; said circular groove having an annular sealing means adapted to seal around the unit when said unit is inserted into said groove, said axial pressure transmitting means engaging said unit for selective reciprocal movement thereof into and out of said groove for respective application of pressure to said plate and for permitting access thereto for replacement.

2. An apparatus according to claim 1, wherein each respective pressure plate has a planar surface traversed by a cooling liquid supplied by said cooling means.

3. An apparatus according to claim 2, wherein the cooling liquid exerts its cooling action on a planar surface formed by a cooling end planar face of the pressure plate arranged in opposition to a planar wearing surface which contacts the pressure roll.

4. An apparatus according to claim 1, wherein the unit is cylindrical and is equipped with a central inner bore wherein a centrally arranged liquid feed pipe is held with annular spacing.

5. An apparatus according to claim 1, wherein the unit is provided, at the front end insertable into the pressure plate, with an annular collecting groove for accommodating a returning cooling liquid, said collecting groove comprising an essential diameter of the unit.

6. An apparatus according to claim 1, wherein a mounting flange is in sealing engagement with the outer circumference of the unit; said mounting flange fixing the unit in a bore of the lateral plate.

7. An apparatus according to claim 6, wherein the mounting flange is provided within the bore with an external thread on which is seated, with a corresponding internal thread, a thrust ring of said pressure transmitting means, which ring is in frictional engagement with the unit at the end facing the pressure plate, and a toothed rim on the outer periphery thereof enabling reversible rotation of said thrust ring and said selective reciprocal movement of said unit.

* * * * *